United States Patent [19]

Wendt

[11] 4,281,480

[45] Aug. 4, 1981

[54] DOORFRAME CONSTRUCTION

[75] Inventor: Alan C. Wendt, Barrington, Ill.

[73] Assignee: U.S. Gypsum Company, Chicago, Ill.

[21] Appl. No.: 50,833

[22] Filed: Jun. 21, 1979

[51] Int. Cl.[3] ..... E06B 1/04

[52] U.S. Cl. ..... 49/504; 52/211; 52/213

[58] Field of Search ..... 49/501, 504, 505; 52/211, 213

[56] References Cited

U.S. PATENT DOCUMENTS

| | | | |
|---|---|---|---|
| 3,130,455 | 4/1964 | Borlenghi | 49/504 |
| 3,320,705 | 5/1967 | Downing, Jr. | 49/504 X |
| 3,345,780 | 10/1967 | McGhee | 49/504 |
| 3,591,985 | 7/1971 | Coppins | 49/504 |
| 3,676,966 | 7/1972 | Ragland | 49/504 X |
| 3,886,688 | 6/1975 | Ragland | 49/504 |
| 4,154,034 | 5/1979 | Bursk et al. | 49/504 X |

*Primary Examiner*—Kenneth Downey

*Attorney, Agent, or Firm*—Glenn W. Ohlson; Robert H. Robinson; Samuel Kurlandsky

[57] ABSTRACT

A doorframe assembly for hollow-wall partition construction is disclosed and comprises metal backer jamb members adapted for attachment to opposite sides of a door opening, a metal header member adapted for attachment to an upper horizontal side of a door opening, vinyl jamb members snap-engaged with the metal backer jamb members, a vinyl header cover snap-engaged with the metal header member, hinge plate means for supporting a door attached within a hinge plate recess along a wall portion of a vinyl jamb member at the hinge side of the door opening, strike plate means adapted for receiving lockset means attached within a strike plate recess along a wall portion of a vinyl jamb member at the lockset side of the door opening, wherein said assembly provides an easily installed, finished, and mortised construction.

16 Claims, 8 Drawing Figures

DOORFRAME CONSTRUCTION

THE BACKGROUND OF THE INVENTION (1) Field of the Invention

The invention relates to a doorframe assembly for a door opening in a hollow-wall partition construction wherein the assembly comprises metal backer jamb members and metal header member snap-engaged by vinyl jamb members and vinyl header cover member respectively which envelop and cover the metal members and provide recesses along wall portions thereof for securement of strike plate means and hinge plate means providing a generally planar finished and mortised surface along the vinyl members.

(2) Description of the Prior Art

Hollow partition wall construction featuring quick installation and field adaptability to particular construction requirements has become very desirable in recent years. Along with this hollow-wall construction, framing for door openings must also allow for ease of installation with members that can be interchangeably used as particular needs arise in an overall office, residence, or factory partition wall system. It has become particularly important to provide framing members which can be interchangeably used and individually altered in the field.

Many prior art doorframe techniques utilize extruded metal and vinyl elements to provide required quick installation. Typically, an exposed extruded jamb member provides slotting or notching for hinge members, securing plate members, door stops, trim plates, strike plates, and an array of necessary hardware elements for doorframing. Unfortunately, many prior systems either restrict attachment of hinge plates to a particular jamb member and a strike plate to an opposing jamb member at the other side of the door opening. Also, some systems have large assortments of accessory parts that involve lengthy installation operations for their attachment. It would be desirable to provide doorframing members which allow reversibility of jamb members with a limited number of accessory parts that would expedite installation and allow interchangeability of members having adaptable use at various door openings without limitation to a specific door opening location in a hollow-wall partition construction.

It has also become a need for the construction industry to provide a door jamb member which permits the variable location of hinge plates without limitation to specifically notched portions. In attempting to solve this problem, past attempts have typically been limited to connection of hinge plates with metal members. With increased costs of providing decorative exposed metal jamb members, the use of extruded vinyls has been explored. Problems, however, have arisen when trying to incorporate extruded vinyl members in that attachment to door opening sides necessitates the use of a sturdy metal backer of some sort. Complex shapes for metal backer jambs have thus been required allowing versatile location of hinge plate means. The hinge plate attachment is then followed by attachment of numerous extruded trim elements concealing unsightly and undecorated metal backer jambs. In many attempted solutions, a difficulty has arisen in providing the necessary thickness of metal backer members that feature sufficiently thick surfaces usable with screw fasteners for affixation of hinge plate means to afford necessary strength for door support. Although hollow-core doors reduce weight and thus alleviate the requirements of extra strength, it would be highly desirable to have adaptability for use with a hollow-core or heavier solid-core door in a hollow-wall partition construction where needed. Conventional solid-core doors may range up to about 120 lbs. and sufficient strength for screw fastener attachment at hinge plate means is mandated. Efforts to provide this have been made wherein additional metal plates, shims, or plate means are inserted along a metal backer jamb behind hinge plate means to provide the necessary thicknesses for the conventional screw fastener attachment of hinge plate means involving the use of a heavier door.

At the side of a typical door opening where strike plate means coact with door locking means, a similar problem for allowing variable location of the strike plate has been confronted. In many recent attempts, the jamb at the strike side of the door opening requires a different shape and manner of installation than the jamb at the hinge side of the door opening. Moreover, pre-cut notches for attachment of a strike plate means necessarily limits the ability to provide members at various door locations having different strike plate height requirements. In previous solutions to reversible jamb member framing, there has typically been provided a complex jamb member which allows for use at either side of the door opening, but requires additional material for extruding, or roll forming, cover plate members and engageable slots on jamb members to attain this feature.

It would be desirable to provide a simplified framing utilizing reversible jamb members with facile installation and few elements.

(3) Objects of the Invention

It is a primary object of this invention to provide a doorframe for hollow-wall partition construction which permits field installing hinges and strike plates along a jamb member at any location for either right-hand or left-hand swinging doors.

It is an important object of this invention to provide snap-on engaging vinyl jamb members which snap-engage a metal backer jamb member to conceal the metal backer jamb member from view.

It is accordingly an object of this invention to also provide a snap-on engaging vinyl header cover which snap-engages a metal header member to conceal the metal header member from view.

An attendant object of this invention is to provide vinyl jamb members which offer the feature of selective hinge plate and strike plate locations in the field for use with a multiplicity of differing door requirements.

A concommitant goal of this invention is to provide attachment means along metal backer jamb members capable of supporting both hollow-core and solid-core door members by hinge means fastened thereto.

A secondary object of this invention is to provide a doorframe assembly which consists of relatively few elements allowing simple installation and low-cost manufacture.

A related object of this invention is to provide snap-engageable vinyl jamb members and vinyl header cover members having exterior portions with esthetically pleasing configurations while at the same time having substantially identical attachment portions useful with metal backer jamb members and metal header members.

SUMMARY OF THE INVENTION

In carrying out the principles of the invention in accordance with a preferred embodiment thereof, a doorframe assembly usable with right-hand and left-hand swinging doors comprises metal backer jamb members adapted for attachment to opposite sides of a door opening and metal header member adapted for attachment to an upper horizontal side of a door opening. The metal backer jamb members and metal header member have substantially the same structural shape comprising a generally U-shape. The metal members have free legs of the U-shape adapted for fastening on opposite wall face surfaces adjacent the door opening. These free legs terminate in lip portions. Additionally, at least one metal backer jamb member has at least one cutout located along a web portion of the U-shape adapted for coaction with lockset means of a door at the lockset side of a door opening.

In accordance with the preferred embodiment of the invention, the doorframe assembly additionally comprises vinyl jamb members and vinyl header cover snap-engaged with the metal backer jamb members and metal header member respectively wherein the vinyl members are of substantially the same structural shape. The vinyl members comprise a body portion having a doorstop with adjacent oppositely extending wall portions covering the web portion of the metal member. Said body portion of these vinyl members terminates in flanges extending from opposite ends thereof, at generally right angles thereto, which terminate in inturned nib portions for snap-engagement with the lip portions of the metal members whereby the metal backer jamb members and metal header member are enveloped and concealed by the vinyl jamb members and vinyl header cover respectively.

Also in line with the present invention, hinge plate means are provided within hinge plate recesses of a wall portion of a vinyl jamb member at the hinge side of a door opening. Additionally, a strike plate means is provided disposed within a strike plate recess along a wall portion of the vinyl jamb member at the lockset side of the door opening.

Consistent with the invention, doorframing for use in a hollow-wall partition construction having two spaced-apart rows of wall panels with opposite wall face surfaces is provided. The doorframing provides in combination: a door opening in the hollow-wall construction having vertical stud members positioned adjacent opposite sides of the door opening; metal backer jamb members at said opposite sides; metal header member at an upper horizontal side of the door opening; vinyl jamb members and vinyl header cover snap-engaged to the metal backer jamb member and metal header members respectively; hinge plate means attachable along wall portions of a vinyl jamb member at either side of the door opening; strike plate means attachable along the vinyl jamb member at the opposite side of the door opening along wall portions of the vinyl jamb member thereof; and, a door member supported within said door opening by hinge means connective attachment to said hinge plate means.

The foregoing, and other objects, advantages, and characterizing features of this present invention, will become clearly apparent from the following description of certain illustrative embodiments thereof, considered along with the accompanying drawings, wherein like reference numerals signify like elements throughout the various figures.

DESCRIPTION OF THE PREFERRED EMBODIMENT

Figure 1:
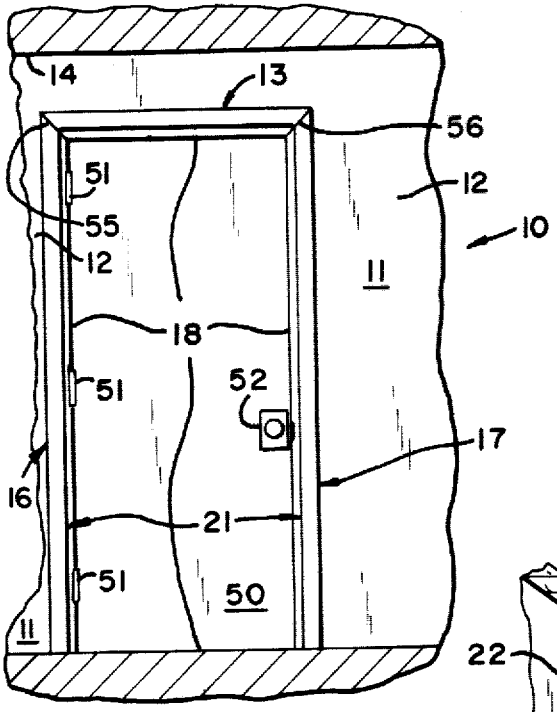
FIG. 1 is an elevational view of a hollow-wall partition construction having a door opening with the preferred embodiment of the doorframe assembly in accordance with the invention.

With reference first to FIG. 1, there is shown, in elevational view, hollow-wall partition 10. This construction is of conventional design, having two spaced-apart rows of panels 11 with exposed panel faces 12. Hollow-wall partition 10 extends from ceiling 14 to floor 15 and has door opening 18 therein. Door opening 18 is bounded at opposing vertical sides denoted as hinge side 16 and lock side 17. The upper and lower bounds of door opening 18 comprise header means 13 at an upper horizontal side and floor 15 at the bottom side. In the preferred embodiment of this invention, doorframe assembly 21 is provided for door opening 18 with door 50 hung therein. Door 50 is attached to doorframe assembly 21 by conventional connective attachment hinge means 51 at hinge side 16. At lock side 17 door member 50 has conventional lockset 52.

Figure 2:
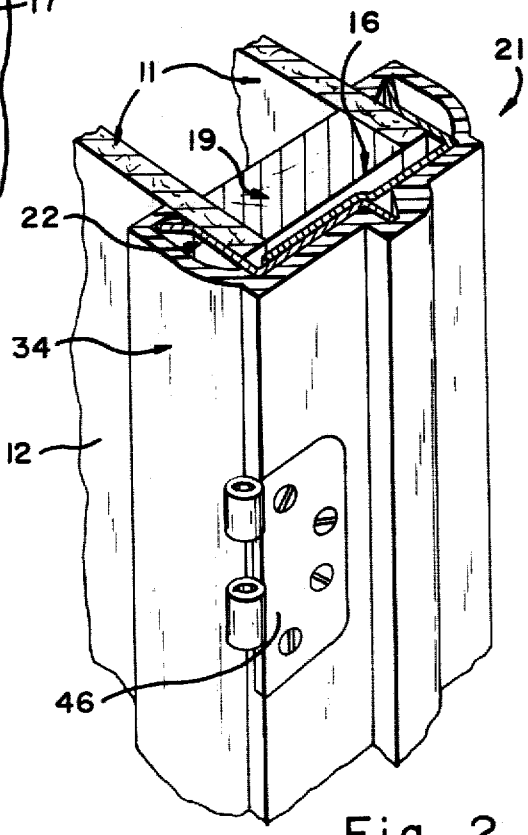
FIG. 2 is a partial perspective view of the hinge side of the door opening shown in FIG. 1 showing the doorframe assembly at that side.
Figure 3:
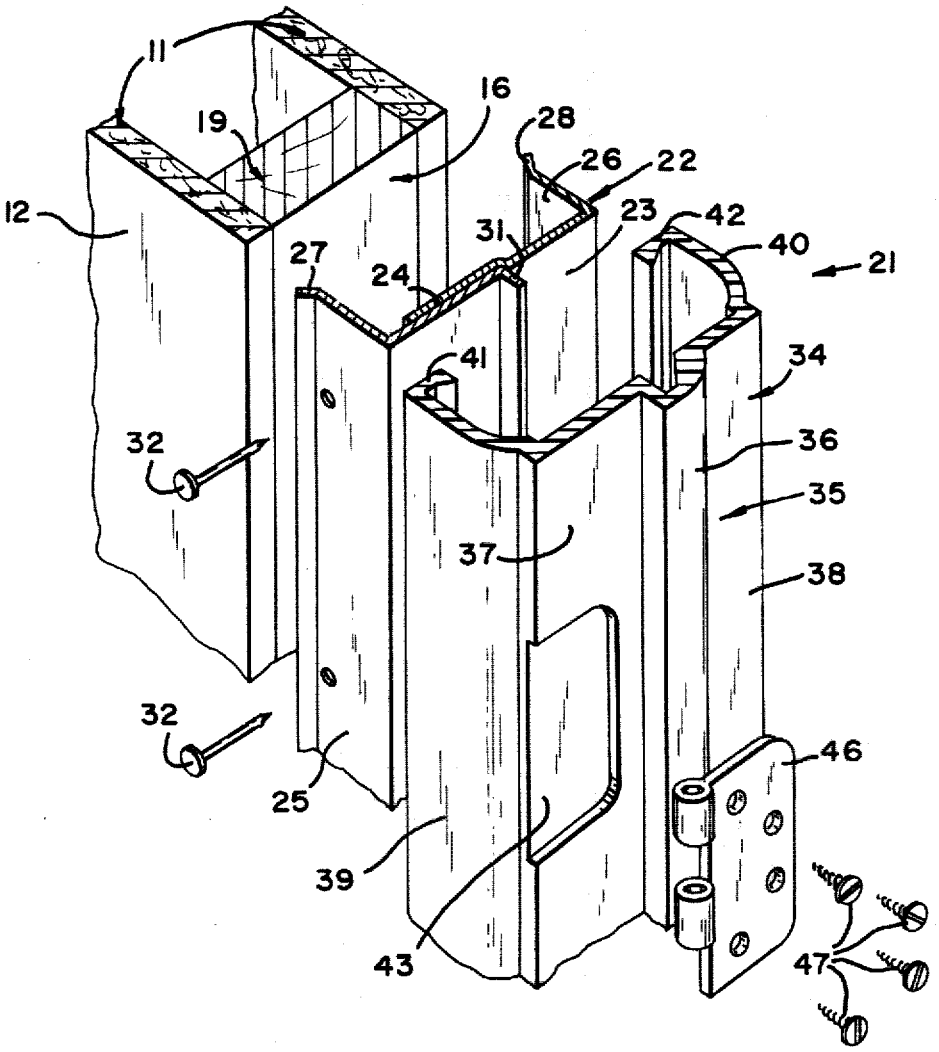
FIG. 3 is an exploded view of the doorframe assembly shown in FIG. 2.

Turning now to FIGS. 2 and 3, doorframe assembly 21 is illustrated at hinge side 16. FIG. 2 presents elements of doorframe assembly 21 in their functionally installed conformation. Positioned adjacent hinge side 16 at the end of panels 11, vertical stud member 19 is shown. In the preferred embodiment, stud 19 comprises a 2×4 wooden member. Within the scope of this invention other utile construction stud members may be used such as metal channel-shaped members. Positioned vertically extending along hinge side 16 resides metal backer jamb member 22. Snap-engaged to metal backer jamb member 22 is vinyl jamb member 34, which conceals and envelops metal backer jamb member 22 from view. It is thus apparent that metal backer jamb member 22 need not extend for the full height of door opening 18 but may be provided to stop short of header means 13. In the preferred embodiment disclosed, door 50 comprises a solid-core door. This type of door is relatively heavy and may reach a weight of 120 pounds. It is accordingly preferred that metal backer jamb member 22 extend to contact floor 15 to provide additional support by bearing thereon. Within the scope of this invention, if a lighter door construction were utilized, such as a hollow-core configuration, metal backer jamb member 22 may be provided to stop short of floor 15 if such bearing support would not be warranted. Because vinyl jamb member 34 is provided for the full height of door opening 18 along hinge side 16, it provides an esthetically pleasing decorative surface whether or not metal backer jamb member 22 extends for the full height. Hinge plate means 46 is illustrated attached to vinyl jamb member 34 in accordance with the preferred embodiment of the invention.

With specific reference to FIG. 3, an exploded perspective view of doorframe assembly 21 at hinge side 16 is depicted. The preferred conformation of metal backer jamb member 22 provides a generally U-shape. This U-shape is formed by a web member 23 having free legs 25 and 26 extending at generally right angles from opposite edges thereof. Free legs 25 and 26 terminate in lip portions 27 and 28 respectively. Fasteners, shown as screws 32, affix free legs 25 and 26 on panel faces 12 by extending through panels 11 to penetrate stud 19. Other equally advantageous attachment devices, such as nails, spikes, and the like, are also adaptable. In the preferred embodiment, metal backer jamb member 22 provides thicker web portion 24 of web member 23. Thicker web portion 24 is desirable when a heavy solid-core door is to be supported by providing additional thickness for secure engagement with screw fasteners therethrough. Web member 23 additionally comprises a generally centrally located inturned leg portion 31. Inturned leg portion 31 is provided to project inwardly into a later-described doorstop portion 36 of vinyl jamb member 34.

Vinyl jamb member 34 has a generally U-shape and is preferably an extruded rigid cellular vinyl well suited to doorframing construction. Vinyl jamb member 34 comprises a body portion 35 having a generally centrally located doorstop portion 36 flanked on either side by oppositely extending walls 37 and 38. At opposite ends of body portion 35, flanges 39 and 40 extend at generally right angles to walls 37 and 38 respectively. Flanges 39 and 40 terminate in inturned nib portions 41 and 42 respectively. The inturned nib portions 41 and 42 extend to register with lip portions 27 and 28 for snap-engagement. Thereby, vinyl jamb member 34, as described, conceals and is supportingly engaged to, metal backer jamb member 22.

Additionally illustrated in FIG. 3, a conventional hinge plate means 46 is attached to vinyl jamb member 34. Hinge plate means 46 is attached to wall portion 37, which is located to be juxtaposed over thicker web portion 24 of metal backer jamb member 22. Wall portion 37 has hinge plate recess 43 therein for affixation of hinge plate means 46 within. Fasteners, preferably self-drilling screws 47, supportively affix hinge plate means 46 by passing through vinyl jamb member 34 and into thicker web portion 24. An important feature of this invention is the versatility and the location of hinge plate recess 43. It is envisioned that routing in the field by conventionally known techniques will allow versatile location of hinge plate recess 43 for particular hinging locations encountered. Hinge plate recess 43 is preferably of a depth substantially equal to the thickness of hinge plate 46 such that a finished mortised appearance along wall portion 37 is provided. Typically, two to four hinge connections support door members in conventional hollow-wall partition construction, but it is within the purview of this invention to be adaptable for use with any normally reasonable number of hinges. In the embodiment herein shown, hinge plate means 46 are provided at three locations along wall portions 37 in positional correspondance with, and connective attachment to, hinge means 51 of door 50.

Figure 4:
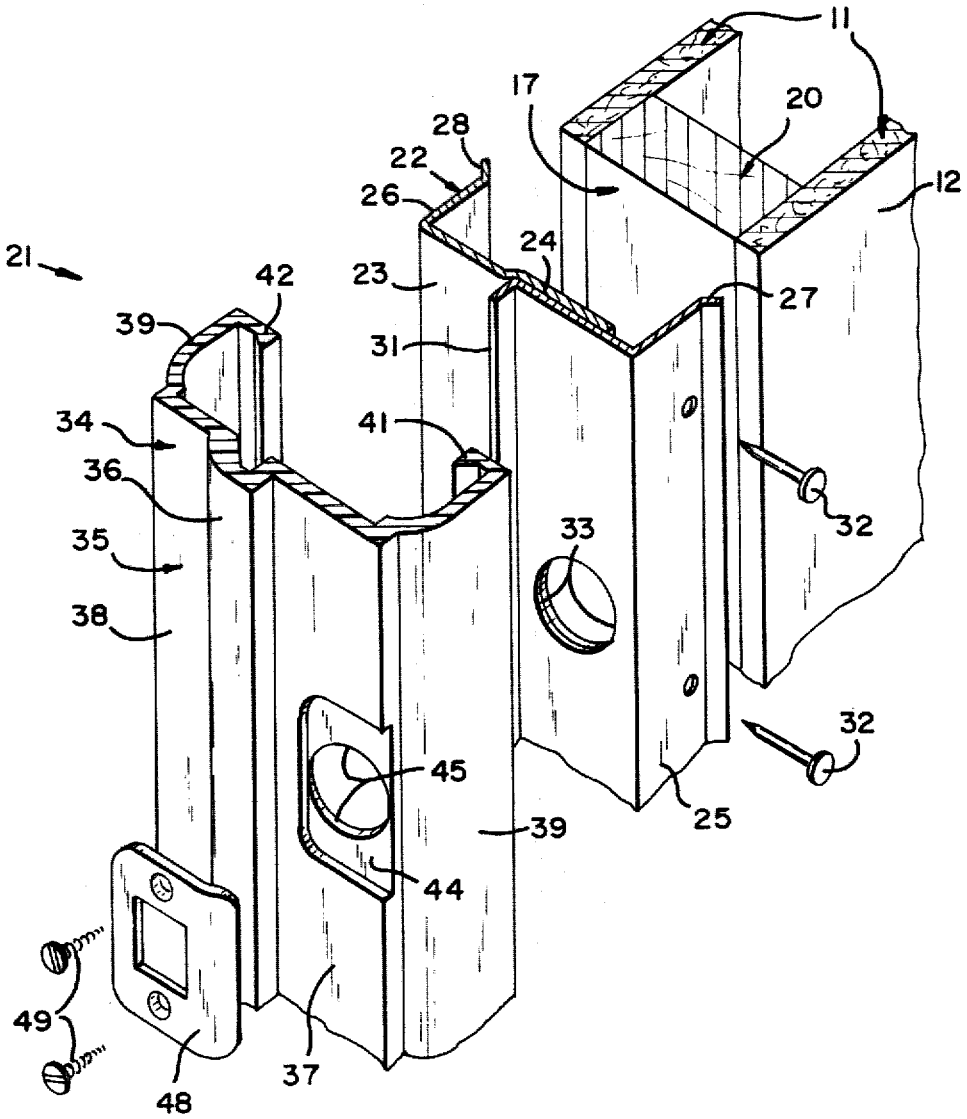
FIG. 4 is an exploded, partial perspective, view of the lockset side of the door opening shown in FIG. 1 comprising the doorframe assembly of this invention at that side.

FIG. 4 is an exploded perspective view showing doorframe assembly 21 at lock side 17 of door opening 18. Lock side 17 similarly provides a wooden 2×4 member labelled stud 20 located adjacent lock side 17 at the ends of panels 11. In the preferred embodiment for doorframe assembly 21, at least one metal backer jamb member 22 is provided with at least one cutout 33 for door lockset means. It is desirable in the construction industry to have interchangeable doorframes for use in a particular building or factory construction wherein a particular standard for the positioning of door locking means and strike plate means is normally provided. In providing cutout 33 at a predetermined location for such construction, the elements of doorframe assembly 21 may be interchangeably used throughout such a construction. It is, however, within the scope of the invention, that metal backer jamb members 22 at lock side 17 not extend for the full height of door opening 18. Thus, where a particular alteration or variance is required, metal backer jamb member 22 may be translated verticaly to position cutout 33 at a proper height to correspond with varying lockset locations. Additionally, field cutting of additional slotting may be accomplished with conventional tools. An alternate desirable embodiment provides a multiplicity of cutouts 33, through thicker web portion 24, whereby metal backer jamb member 22 would be adaptable to multiple doorframing requirements, without the necessity of field cutting, when more than one standard is used for vertical location of lockset means.

At lock side 17, vinyl jamb member 34 is snap-engaged to metal backer jamb member 22. Being reversible, vinyl jamb members 34 may be interchangeably used at either hinge side 16 or lock side 17. As illustrated, wall portion 37 resides juxtaposed over thicker web portion 24. A lockset recess 44 is provided in wall portion 37 for affixation of a conventional strike plate 48. Additionally, an aperture 45 in lockset recess 44 is provided for extension of bolts, and locking means, or the like, therethrough. This aperture 45 and lockset recess 44 positionally correspond to the cutout 33. Strike plate 48 is of a conventional design and is preferably attached by fasteners such as self-drilling screws 49, well known to the industry. The dimensions of aperture 45 and cutout 33 are provided, as is apparent, for less than the full vertical dimension of strike plate 48, thereby allowing screws 49 to have sufficient room to extend through thicker web portion 24 for proper affixation. The shape of lockset recess 44 and aperture 45 may be individually routed and cut in the field as a particular strike plate configuration or lockset is encountered. The depth of lockset recess 44 is substantially the same as the thickness of strike plate 48 such that upon installation a finished mortised surface along wall portion 37 is thereby provided. In the preferred embodiment lockset recess 44 stops short of doorstop 36 but in accordance with this invention may extend thereto.

Figure 5:
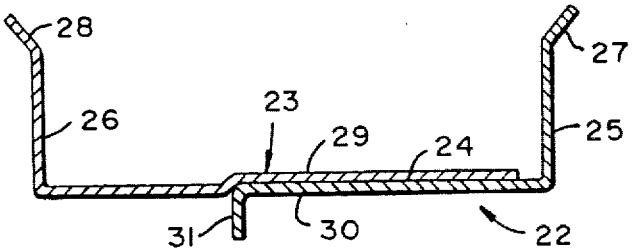
FIG. 5 is a cross-sectional view of the preferred embodiment for the metal backer jamb member of the doorframe assembly in accordance with this invention.

FIG. 5 shows, in cross-sectional view, the preferred embodiment for metal backer jamb member 22. In this preferred form, metal backer jamb member 22 comprises two elements each having a generally L-shape with free legs 25 and 26, and overlapping legs 29 and 30. The overlapping of legs 29 and 30 is not provided for the full width of web member 23, but rather is provided for substantially the same width as juxtaposed wall portion 37 of vinyl jamb member 34 for attachment of the previously described components. The overlap portion forms thicker web portion 24 wherein the non-overlap portion provides the remainder of web member 23. Overlap leg 30 preferably terminates in inturned leg portion 31 extending at generally right angles thereto. Inturned leg portion 31 is provided to positionally correspond with, and extend into, doorstop 36 of vinyl jamb member 34 for support. The material preferably comprising metal backer jamb member 22 is 22-gauge galvanized steel (0.030 inches). And therefore the thickness of thicker web portion 24 will be approximately 0.060 inches, providing sufficient thickness for hinge attachment by self-drilling screws and being capable of providing sufficient thickness to support doors ranging up to about 120 pounds. The range of thickness when using galvanized steel may be from about 0.022 inches to about 0.052 inches. Sufficient strength and stability is provided thereby for adaptation with conventional door members utilizing both hollow and solid-core construction. In an alternate preferred embodiment for the material comprising metal backer jamb member 22, it is envisioned that extruded aluminum be used. With extruded aluminum, web member 23 would not have overlapping legs, but would rather have a thicker web portion 23 being a solid extruded portion thicker than remaining portions. Where an aluminum extrusion is used it is desirable that the thickness preferably be about 0.062 inches generally throughout and a thickness of thicker web portion 24 of about 0.125 inches. A suitable range of thicknesses for extruded aluminum is from about 0.040 inches to about 0.075 inches generally throughout and from about 0.080 inches to about 0.150 inches in thicker web portion 24.

Metal backer jamb member 22, as depicted, comprises an integral construction having overlapped legs 29 and 30 spot welded together to thereby provide a substantially unitized one-piece member.

Figure 6:
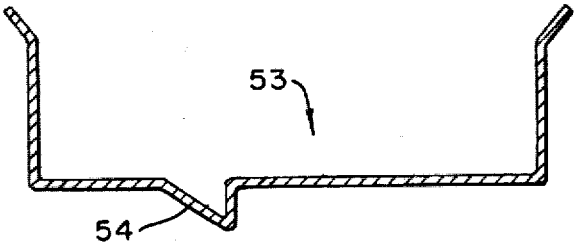
FIG. 6 is a cross-sectional view of an alternate preferred embodiment for the metal backer jamb member and being also the preferred embodiment for the metal header member of the doorframe assembly of the invention.

FIG. 6 illustrates header member 53 in the preferred form of this invention for use as previously noted header means 13 shown in FIG. 1. Header member 53 is of substantially the same conformation as metal backer jamb member 22 but provides an upraised doorstop support 54 rather than an inturned leg portion 51. Doorstop support 54 comprises a shape adapted to supportively nest behind doorstop 36 of vinyl jamb member 34. It preferably comprises 22-gauge galvanized steel (0.030 inches) and may range in thickness of from about 0.022 inches to about 0.052 inches. Similarly, header member 53 may alternatively comprise an aluminum extrude having a desirable thickness in the range of from about 0.040 inches to about 0.075 inches. When lighter doors are used, header member 53 may be provided as the alternate preferred embodiment for a vertical jamb member as well as for header means 13. With a lighter door a thicker web is not required and the construction shown for header member 53 suffices. It is within the scope of the invention to alternatively utilize header member 53 as a vertical jamb member for heavier solid-core doors by providing screws 47 of sufficient lengths to extend into stud members at a hinge side of a door opening for attainment of necessary door support. Being of substantially the same construction as metal backer jamb member 22, vinyl jamb members 34 snap-engage header member 53 in identically the same manner. Upraised doorstop support 54 matches the shape of doorstop 36 to provide support therebehind.

Figure 7:
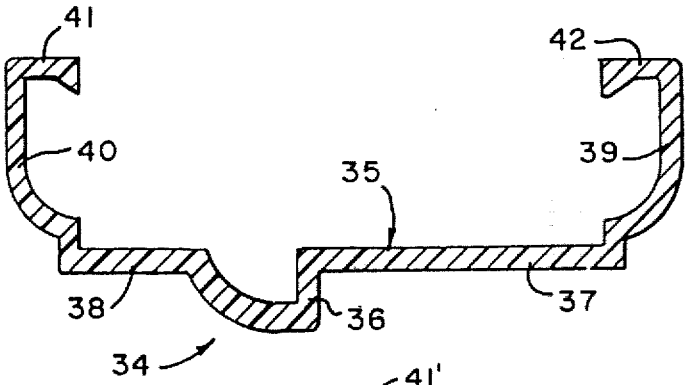
FIG. 7 is a cross-sectional view of the preferred embodiment for the vinyl jamb member and vinyl header cover having a particular decorative outer configuration for the doorframe assembly in accordance with the invention.
Figure 8:
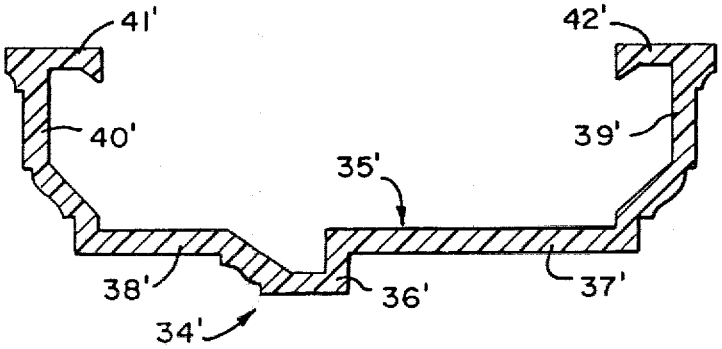
FIG. 8 is a cross-sectional view of the vinyl jamb member and vinyl header cover substantially the same as shown in FIG. 7 but having an alternative decorative outer configuration for the doorframe assembly in line with the invention.

FIG. 7 and FIG. 8 show in cross-sectional view the alternate preferred embodiments for vinyl jamb member 34 and are substantially the same, differing only in the decorative exterior configuration. Numbers 34–42 of FIG. 7 correspond to the elements denoted by numerals 34'–42' of FIG. 8. Vinyl jamb members 34–34' comprises a body portion 35–35' having a generally centrally located doorstop 36–36', which is upraised and generally hollow-backed. Doorstop 36–36' is equally adaptable for supportive engagement with inturned leg 31 of metal backer jamb member 22 or doorstop support 54 of metal header member 53. Extending in opposite directions from doorstop 36–36' are walls 37–37' and 38–38'. Walls 37–37' and 38–38' respectively terminate in flanges 39–39' and 40–40' extending at generally right angles thereto. Flanges 39–39' and 40–40' terminate in inturned nib portions 41–41' and 42–42' respectively, which are positioned to snap-engage with lip portions 27 and 28 of metal backer jamb members 22 or snap-engage with previously described header member 53. Vinyl jamb member 34–34' is thus provided to extend across the upper side of door opening 18 at header means 13 snap-engaging header member 53 for concealment thereof. Vinyl jamb member 34–34' is therefore shown, in the preferred embodiment, used as a vinyl header cover and vinyl jamb member. When utilized as a header cover, vinyl jamb member 34–34' is not field-routed or provided with holes or apertures since such are usually unnecessary at header means 13. It is thus apparent that vinyl jamb member 34–34' is functional both as a snap-on concealment for metal backer jamb members 22 as well as header member 53. This versatility permits the installer to use scrap jamb pieces for coverage of header members without the need for a different shaped member. At the juncture of header means 13 with hinge side 16 and lock side 17, the vinyl jamb members and vinyl header cover members are mitered at junctures 55 and 56 to provide a finished appearance. Such mitering may be accomplished in the field using conventional tools therefor. Within the scope of the invention, header member 53 may be provided to extend for less than the full width of door opening 18 because it would be enveloped and concealed by the attachment of vinyl jamb member 34–34' shown used as a vinyl header cover. As will also be apparent to one skilled in the art, scrap pieces of metal backer jamb members, when used with the configuration shown for header member 53, may be used at header means 13. If a previously cut slot were made, the piece of metal may still be used since unsightly portions are covered by the vinyl backer jamb 34–34' used as a vinyl header cover.

Thus it is apparent that there has been provided, in accordance with the invention, a doorframe assembly for use in hollow-wall partition construction that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A doorframe assembly comprising in combination:

metal backer jamb members adapted for attachment to opposite sides of a door opening, said members being of substantially the same structural shape having a web portion connecting free legs forming a generally U-shape, said free legs being adapted for fastening on opposite wall face surfaces adjacent a door opening in hollow-wall partition construction, the free legs terminating in lip portions wherein at least one metal backer jamb member has a cutout portion adapted for coaction with a lockset;

metal header member adapted for attachment to an upper horizontal side of a door opening, said member being of substantially the same structural shape as the metal backer jamb members;

vinyl jamb members snap-engaged to the metal backer jamb members, said vinyl jamb members being of substantially the same structural shape having a generally U-shape comprising a body portion covering the web portion of the metal backer jamb members, said body portion comprising a generally centrally located doorstop portion with adjacent walls extending in opposite directions from said doorstop, said body portion having flanges extending from opposite edges of the walls, the flanges terminating in inturned nib portions snap-engaging said lip portions of the metal backer jamb members whereby said metal backer jamb members are enveloped by said vinyl jamb members;

vinyl header members snap-engaged with the metal header member, said vinyl header member being of substantially the same structural shape as said vinyl jamb members;

hinge plate means for supporting a door, said hinge plate means attached to a wall of said vinyl jamb member positioned within a recess along said wall at the hinge side of a door opening;

a strike plate means for coaction with a door lockset, said strike plate means attached to a wall of a vinyl jamb member at the lock side of a door opening within a recess of said wall, said strike plate means being attached in positional correspondence with a cutout portion of a metal backer jamb member at said lock side of a door opening;

wherein said snap-engaged vinyl jamb members provide a finished and mortised conformation at the hinge side and lock side, and said vinyl header member provides a finished and mortised conformation along said upper horizontal side, wherein said vinyl jamb members and vinyl header members are mitered at their intersection.

2. A doorframe assembly as claimed in claim 1 wherein the metal backer jamb members have a portion of the web thicker than remaining portions.

3. A doorframe assembly as claimed in claim 2 wherein the thicker web portion of the metal backer jamb member has a thickness of from about 0.044 inches to about 0.150 inches and the remaining portions have a thickness of from about 0.022 inches to about 0.075 inches.

4. A doorframe assembly as claimed in claim 3 wherein the metal backer jamb member comprises two L-shaped steel members rigidly connected along overlapped leg portions forming the generally U-shape and forming the thicker web portion at said overlapped leg portions.

5. A doorframe assembly as claimed in claim 3 wherein the metal comprising the metal backer jamb is extruded aluminum.

6. A doorframe assembly as claimed in claim 1 wherein the web portion of the metal backer jamb member and metal header member comprises web portions having a generally centrally located doorstop support portion in positional correspondence with the doorstop portion of the snap-engaged vinyl jamb member and vinyl header cover wherein said doorstop support portion extends inwardly of the door opening and projects into the doorstop portion.

7. A doorframe assembly as claimed in claim 1 wherein the hinge plate means and strike plate means are fastened to the hinge plate recess and lockset recess respectively by means of self-drilling screws penetrating the vinyl jamb members and engaging the web of said metal backer jamb members.

8. In combination:

a hollow wall partition construction having two spaced apart rows of wall panels with opposite wall face surfaces;

a door opening in said hollow wall partition construction having vertical stud members positioned adjacent opposite vertical sides of the door opening;

metal backer jamb members at said opposite vertical sides of said door opening, said members being of substantially the same structural shape having a web portion connecting free legs forming a generally U-shape, said metal backer jamb members fastened at opposite wall face surfaces by means of fasteners attaching the free legs on said wall face surfaces, said free legs terminating in lip portions projecting outwardly from said wall face surfaces wherein at least one metal backer jamb member has at least one cutout portion along the web portion adapted for coaction with a door lockset means;

metal header member at an upper horizontal side of said door opening, said member being of substantially the same structural shape as said metal backer jamb members, said metal header member fastened at opposite wall face surfaces by means of fasteners attaching free legs on said wall face surfaces, said free legs terminating in lip portions projecting outwardly from said wall face surfaces;

vinyl jamb members snap-engaged to said metal backer jamb members, said vinyl jamb members being of substantially the same structural shape having a generally U-shape comprising a body portion and a generally centrally located doorstop portion, wall portions extending in opposite directions from said doorstop, said body portion covering the web portion of a metal backer jamb member, the walls terminating at opposite sides in flanges extending at generally right angles thereto and extending over the free legs of the metal backer jamb member, said free legs terminating in inturned nib portions snap-engaging the lip portions of said free legs whereby the vinyl jamb member envelopes the metal backer jamb member;

vinyl header cover members snap-engaged to the metal header member, said vinyl header cover being of substantially the same structural shape as said vinyl jamb members, the body portion thereof covering the web portion of the metal header member, and the flanges extending over the free legs of the metal header member, wherein the inturned nib portions snap-engage the lip portions of the free legs whereby the vinyl header cover envelops the metal header member;

hinge plate means attached along a wall portion of a vinyl jamb member at a hinge side of said door opening, said hinge plate means disposed within a hinge plate recess along said wall portion;

strike plate means attached in positional correspondence with a cutout portion of a metal backer jamb member at the lockset side of the door opening, said strike plate means disposed within a lockset recess along a wall portion of a vinyl jamb member; and, a door member supported within said door opening by hinge means connective attachment along an edge thereof to said hinge plate means;

whereby said vinyl jamb members and vinyl header covers are mitered at the intersections between the opposite vertical sides and horizontal side of said door opening, and whereby said vinyl jamb members and vinyl header covers provide a finished mortised surface.

9. The combination according to claim 8 wherein said vinyl jamb member at the lockset side of the door opening has an aperture in said lockset recess in positional correspondence with a cutout portion of the snap-engaged metal backer jamb member.

10. The combination according to claim 8 wherein the metal backer jamb member has a portion of the web portion being thicker than the remaining portions of the member, having a thickness of from about 0.044 inches to about 0.150 inches and the remaining portions of the member having a thickness of from about 0.022 inches to about 0.075 inches.

11. The combination according to claim 10 wherein the metal backer jamb member comprises two L-shaped steel members rigidly connected along overlapped leg portions forming the general U-shape and forming said thicker web portion along said overlapped leg portion.

12. The combination according to claim 10 wherein the metal backer jamb member comprises extruded aluminum.

13. The combination according to claim 8 wherein the web portion of the metal backer jamb members and metal header member comprise a generally centrally located doorstop support portion positionally corresponding with the doorstop portion of the snap-engaged vinyl jamb members and vinyl header cover respectively, whereby said doorstop support portion extends inwardly of the door opening and projects into the doorstop portion.

14. The combination according to claim 8 wherein the hinge plate means and strike plate means are fastened within said hinge plate recess and lockset recess respectively by means of self-drilling screws penetrating the vinyl jamb member and engaging the web portion of the metal backer jamb members.

15. The combination according to claim 8 wherein at least one metal backer jamb member extends for less than the full height of the door opening.

16. The combination according to claim 8 wherein the metal header member extends for less than the full width of the door opening.

* * * * *